US010333250B2

(12) United States Patent
Xiao et al.

(10) Patent No.: US 10,333,250 B2
(45) Date of Patent: Jun. 25, 2019

(54) ELECTRICAL CONNECTOR ASSEMBLY

(71) Applicant: FOXCONN INTERCONNECT TECHNOLOGY LIMITED, Grand Cayman (KY)

(72) Inventors: Xue-Yuan Xiao, Kunshan (CN); Ling-Jie Meng, Kunshan (CN); Zi-Qiang Zhu, Kunshan (CN); Wei Wang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/870,876

(22) Filed: Jan. 13, 2018

(65) Prior Publication Data

US 2018/0205174 A1 Jul. 19, 2018

(30) Foreign Application Priority Data

Jan. 14, 2017 (CN) ..... 2017 1 0026556
Jan. 14, 2017 (CN) ..... 2017 1 0026557
Jan. 14, 2017 (CN) ..... 2017 2 0043428 U

(51) Int. Cl.

| | |
|---|---|
| ***H01R 13/04*** | (2006.01) |
| ***H01R 13/627*** | (2006.01) |
| ***H01R 13/514*** | (2006.01) |
| ***H01R 12/71*** | (2011.01) |
| ***H01R 12/73*** | (2011.01) |
| ***H01R 24/66*** | (2011.01) |
| ***H01R 24/76*** | (2011.01) |
| ***H01R 13/10*** | (2006.01) |
| *H01R 107/00* | (2006.01) |

(52) U.S. Cl.
CPC ..... *H01R 13/6271* (2013.01); *H01R 12/716* (2013.01); *H01R 12/73* (2013.01);
(Continued)

(58) Field of Classification Search
CPC ..... H01R 13/6271; H01R 12/735; H01R 13/6273; H01R 24/76; H01R 24/66;
(Continued)

(56) References Cited

U.S. PATENT DOCUMENTS 4,979,915 A * 12/1990 Pitts ..... H01R 13/04 439/595
5,080,603 A * 1/1992 Mouissie ..... H01R 23/10 439/353

(Continued)

FOREIGN PATENT DOCUMENTS

TW I374588 10/2012

*Primary Examiner* — Truc T Nguyen
(74) *Attorney, Agent, or Firm* — Wei Te Chung; Ming Chieh Chang

(57) ABSTRACT

An electrical connector assembly including a first connector and a second connector mated with each other. The first connector includes an insulative housing with a mating cavity sounded by opposite top wall and bottom wall, two opposite side walls and a rear wall. The rear wall forms opposite inner surface and outer surface. A plurality of contacts are retained to the housing and include the contacting sections exposed in the mating cavity and soldering sections exposed outside of the housing and behind the rear wall. A plurality of inner partitions are formed on the interior surface of the rear wall and extend into the mating cavity to separate the contacting sections of the neighboring contacts, respectively. A plurality of outer partitions are formed on the exterior surface of the rear wall to separate the soldering sections of the neighboring contacts.

20 Claims, 17 Drawing Sheets

(52) U.S. Cl.
CPC ..... *H01R 12/735* (2013.01); *H01R 13/04* (2013.01); *H01R 13/10* (2013.01); *H01R 13/514* (2013.01); *H01R 13/6273* (2013.01); *H01R 24/66* (2013.01); *H01R 24/76* (2013.01); *H01R 2107/00* (2013.01)

(58) Field of Classification Search
CPC .... H01R 12/716; H01R 12/73; H01R 13/514; H01R 13/04; H01R 13/10; H01R 2107/00
See application file for complete search history.

(56) References Cited

U.S. PATENT DOCUMENTS 5,342,221 A * 8/1994 Peterson ..... H01R 13/514 439/677
5,820,403 A * 10/1998 Cheng ..... H01R 13/6273 439/404
6,860,765 B1 * 3/2005 Spink, Jr. ..... H01R 12/716 439/680
8,602,828 B2 * 12/2013 Li ..... H01R 13/642 439/247
8,860,889 B2 * 10/2014 Choi ..... H01R 23/7073 348/730
2003/0003803 A1 * 1/2003 Billman ..... H01R 13/514 439/607.05
2007/0054544 A1 * 3/2007 Hirata ..... H01R 12/79 439/495
2008/0299811 A1 * 12/2008 Battista ..... H01R 13/6273 439/345
2010/0279534 A1 * 11/2010 Byrnes ..... H01R 13/6273 439/329
2014/0273650 A1 * 9/2014 Reeves ..... H01R 13/648 439/660
2016/0056552 A1 * 2/2016 Geske ..... H01R 4/48 439/660

* cited by examiner

ELECTRICAL CONNECTOR ASSEMBLY

1. FIELD OF THE DISCLOSURE

The invention is related to an electrical connector assembly, and particularly to an electrical connector assembly with latches and partitions.

2. DESCRIPTION OF RELATED ARTS

U.S. Pat. No. 8,043,127 discloses the electrical connector assembly with mated connectors wherein the neighboring contacts lack proper partitions for separation therebetween. On the other hand the latching mechanism between the coupled connectors is applied to only one side thereof, thus tending unstable.

Therefore, it is desired to have an electrical connector equipped with the partitions to separate the neighboring contacts.

SUMMARY OF THE DISCLOSURE

To achieve the aforementioned object, an electrical connector assembly including a first connector and a second connector mated with each other. The first connector is of a header type and the second connector is of a silo type. The first connector includes an insulative housing with a mating cavity sounded by opposite top wall and bottom wall, two opposite side walls and a rear wall. The rear wall forms opposite inner surface and outer surface. A plurality of pin type contacts are retained to the housing and include the contacting sections exposed in the mating cavity and soldering sections exposed outside of the housing and behind the rear wall. A plurality of inner partitions are formed on the interior surface of the rear wall and extend into the mating cavity to separate the contacting sections of the neighboring contacts, respectively. A plurality of outer partitions are formed on the exterior surface of the rear wall to separate the soldering sections of the neighboring contacts. Correspondingly, the second connector includes an insulative housing with a plurality of silos separated by grooves, and a plurality of resilient contacts disposed in the corresponding silos, respectively. During mating, the partitions of the first connector are respectively received within the corresponding partition grooves of the second connector, and the pin type contacts of the first connector are inserted into the corresponding silos and mated with the corresponding resilient contacts of the second connector, respectively. The housing of the second connector further includes three sided latches to be locked to the housing of the first connector.

DETAILED DESCRIPTION OF THE PREFERRED EMBODIMENT

Figure 1:
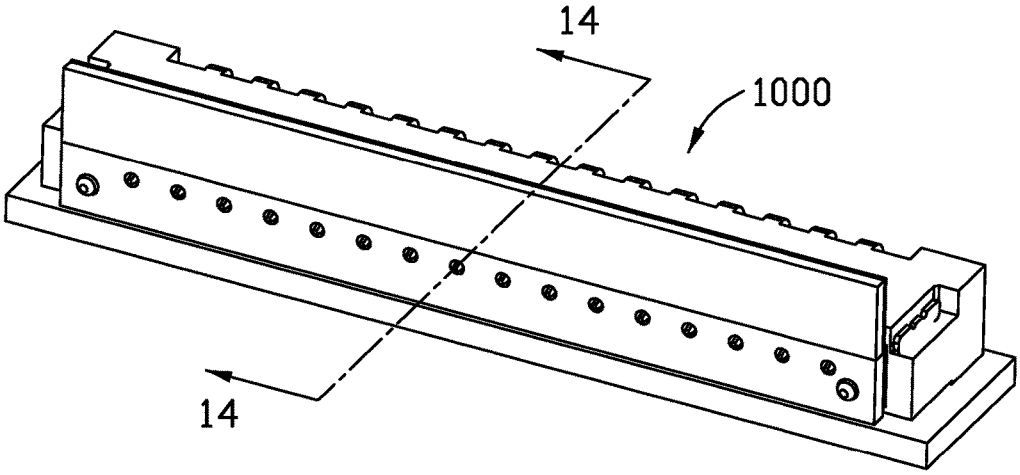
FIG. 1 is a perspective view of the electrical connector assembly with the first connector and the second connector mated together according to the invention.
Figure 2:
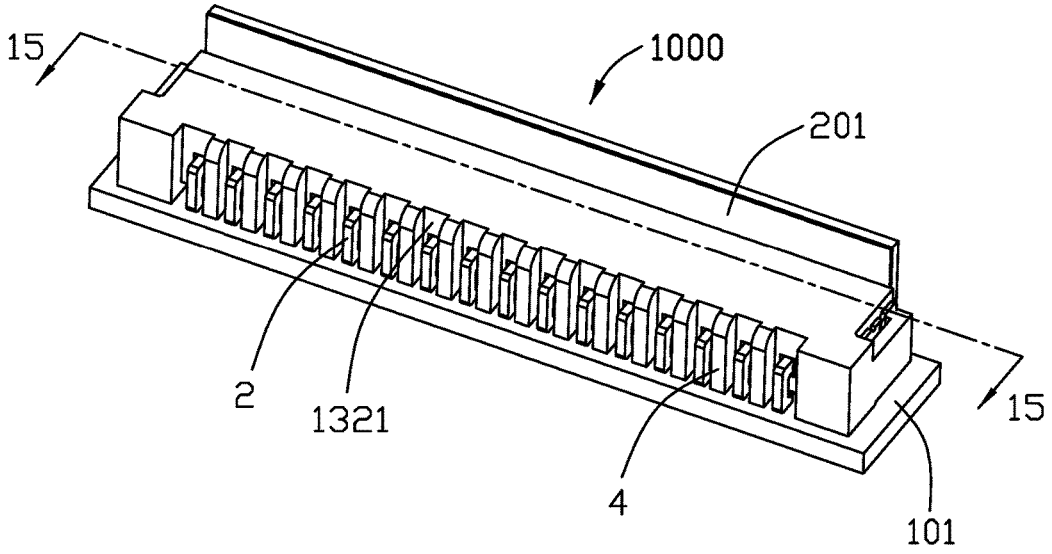
FIG. 2 is another perspective view of the electrical connector assembly of FIG. 1.
Figure 3:
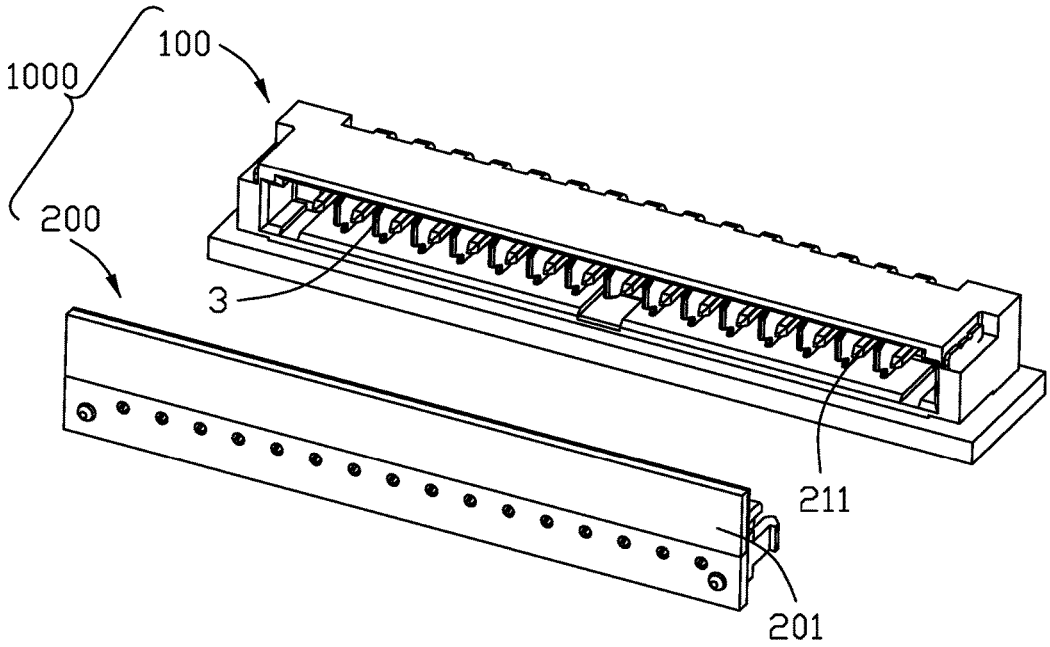
FIG. 3 is a perspective view of the electrical connector assembly of FIG. 1 with the first connector and the second connector are separate from each other.
Figure 4:
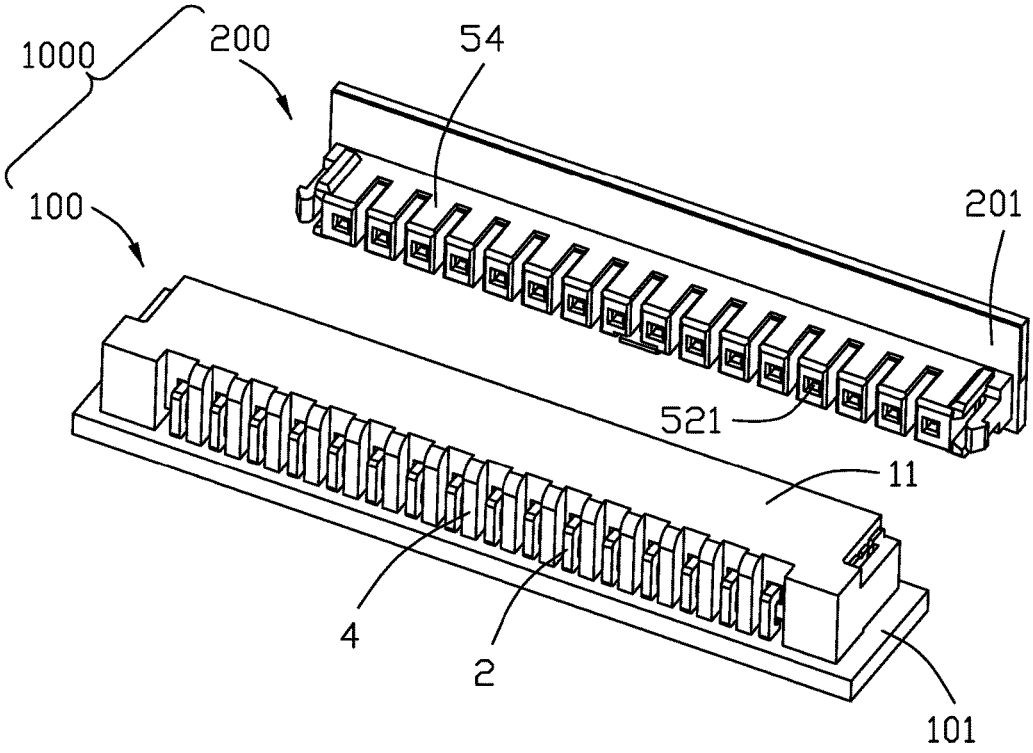
FIG. 4 is another perspective view of the electrical connector of FIG. 3.
Figure 5:
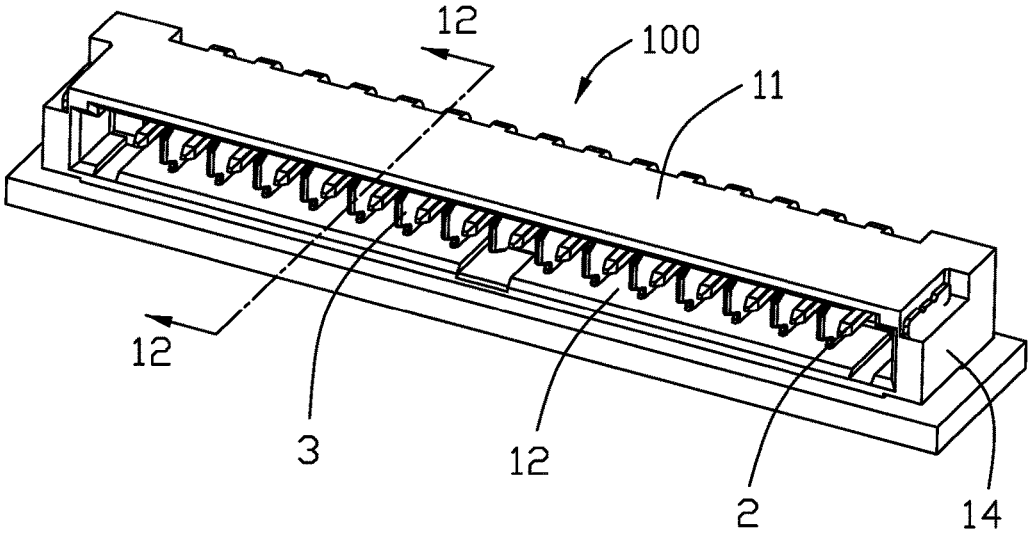
FIG. 5 is a perspective view of the first connector of the electrical connector assembly of FIG. 3.
Figure 6:
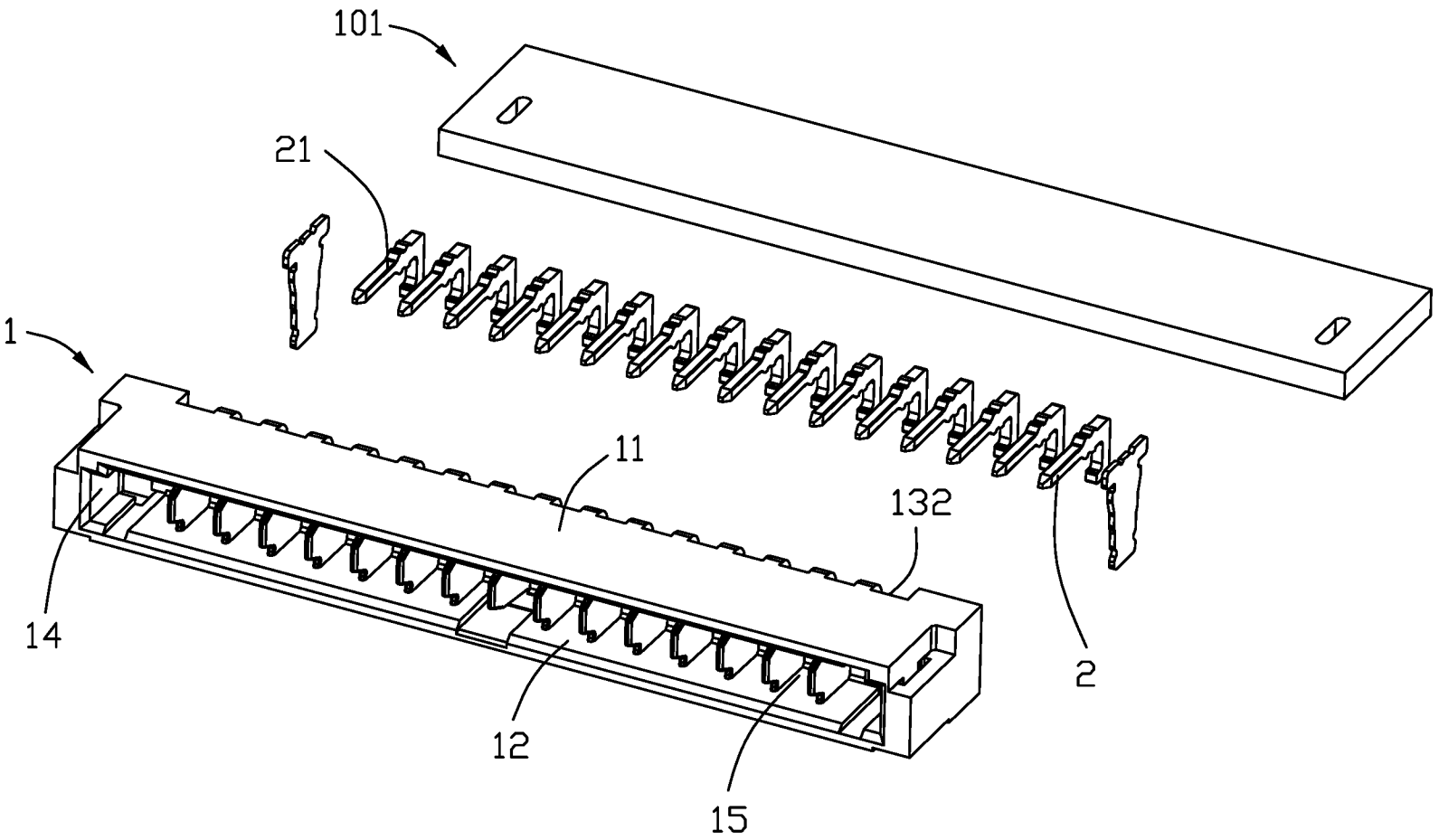
FIG. 6 is an exploded perspective view of the first connector of the electrical connector assembly of FIG. 5.
Figure 7:
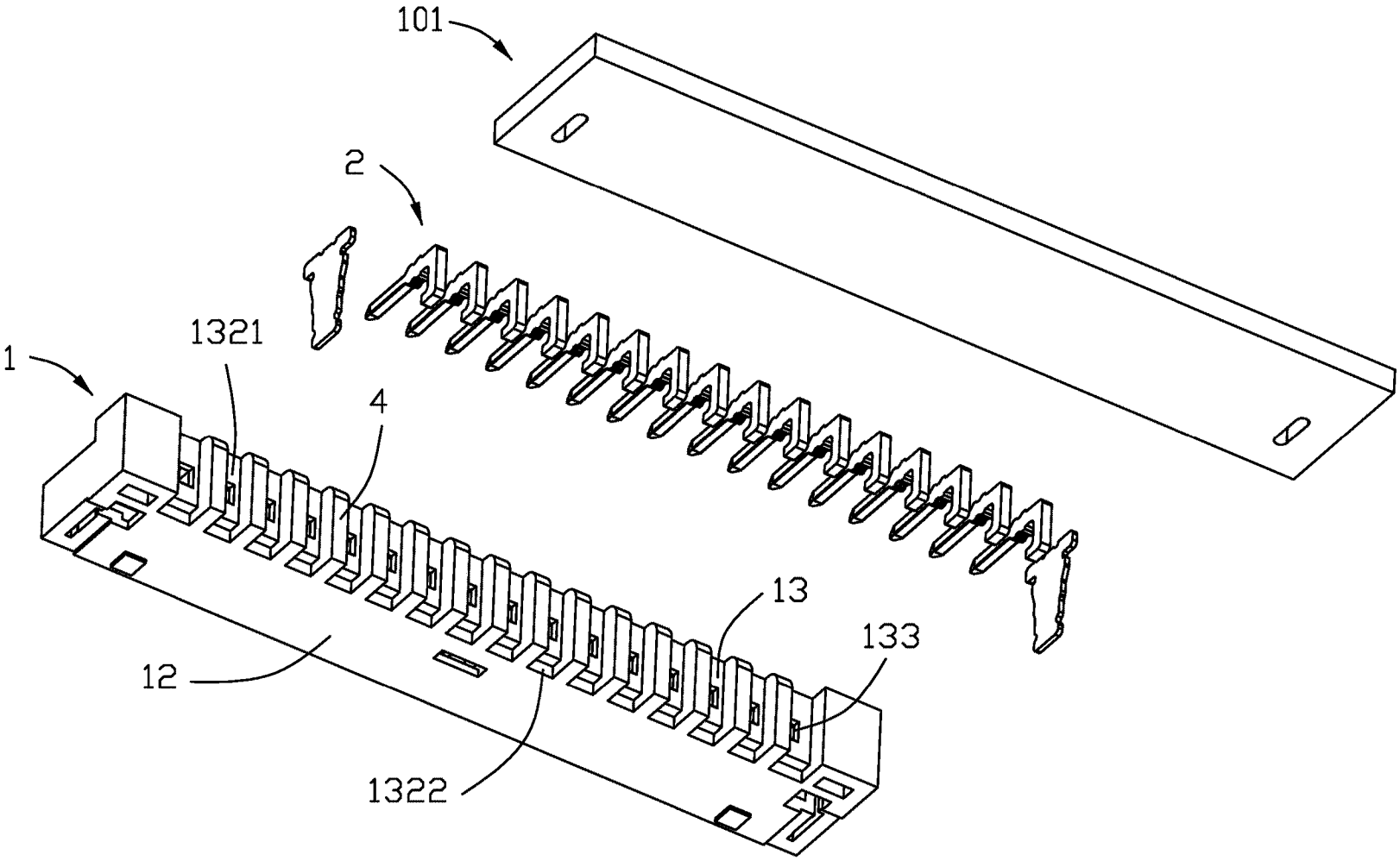
FIG. 7 is another exploded perspective view of the first connector of the electrical connector assembly of FIG. 6.
Figure 8:
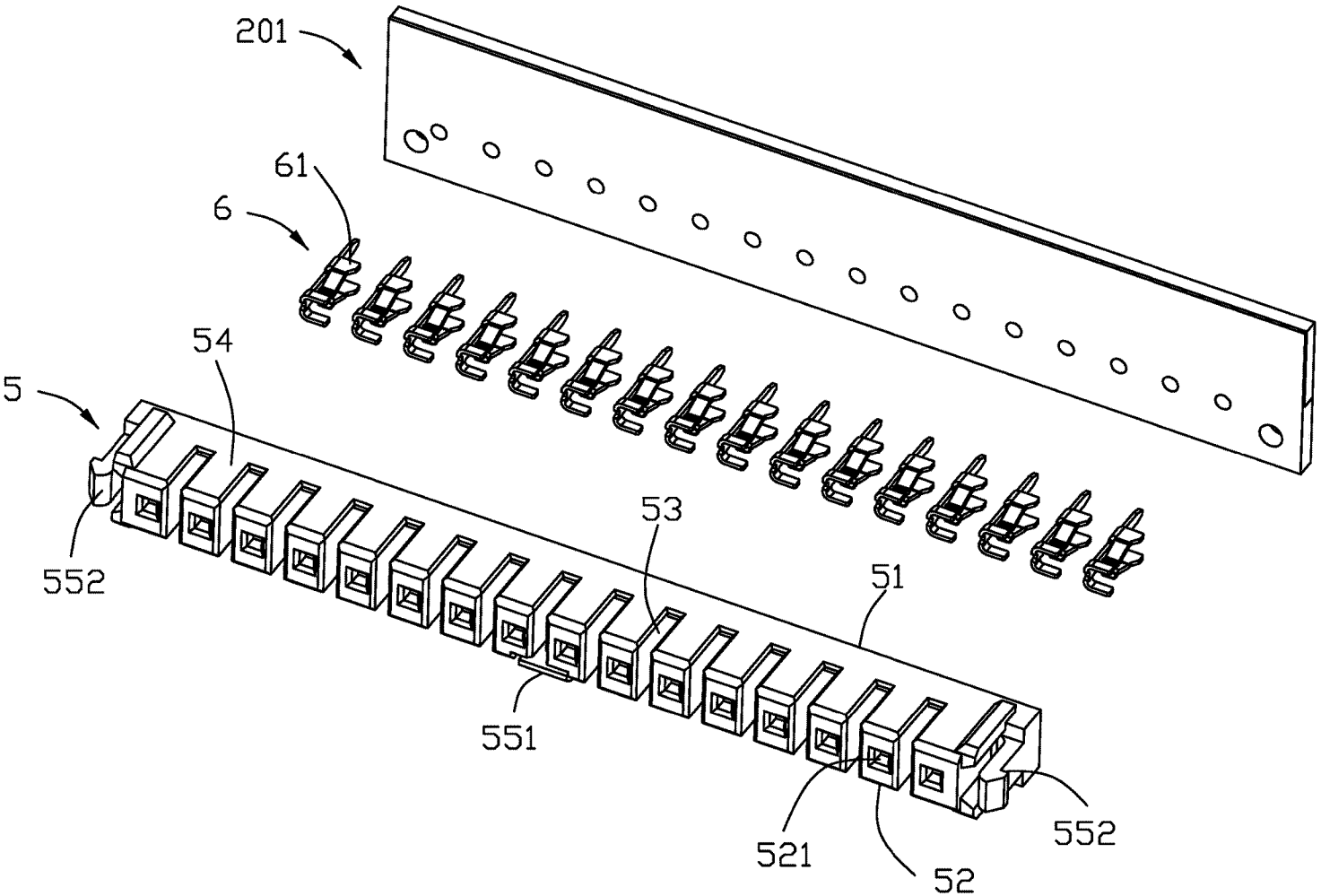
FIG. 8 is an exploded perspective view of the second connector of the electrical connector assembly of FIG. 3.
Figure 9:
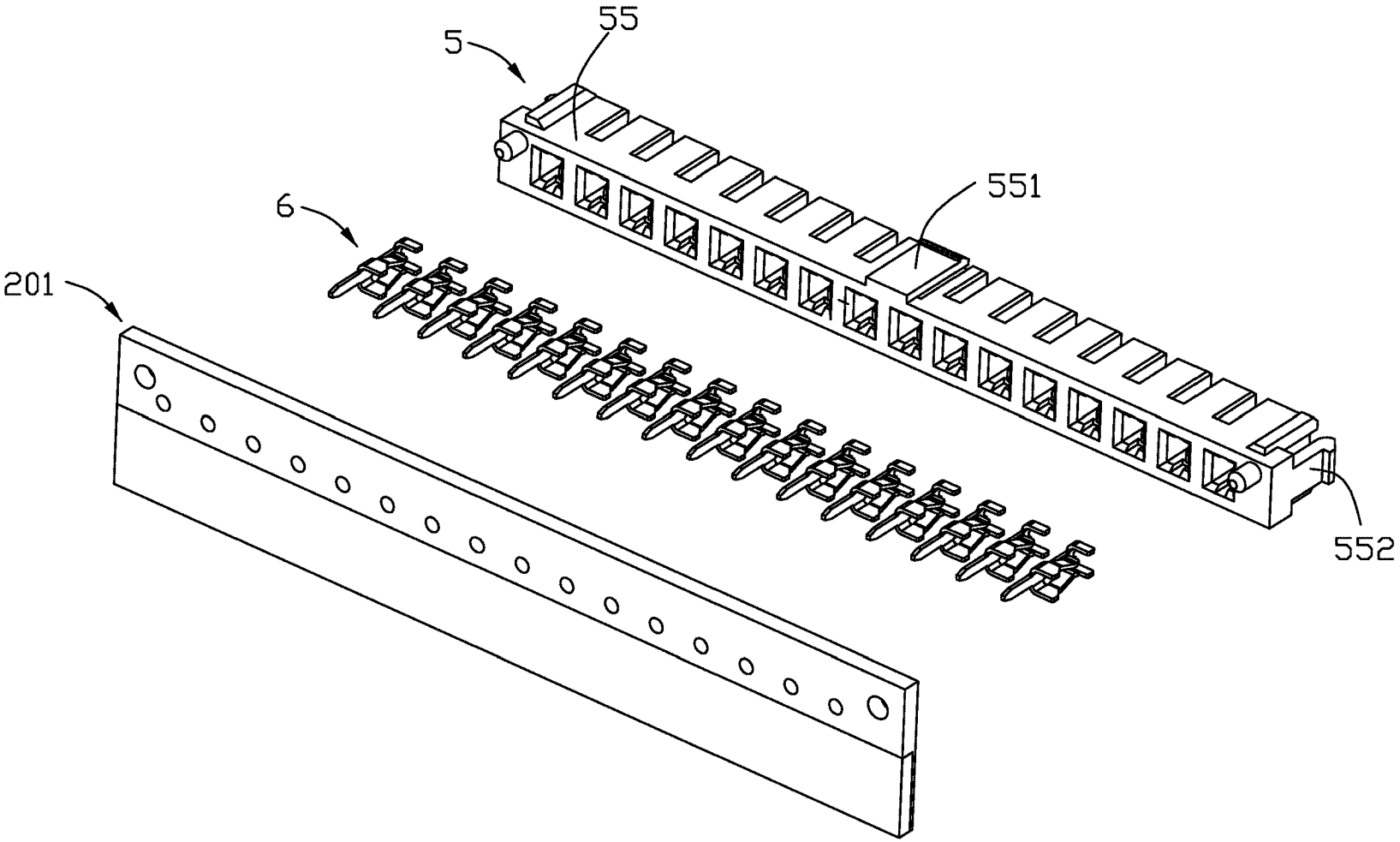
FIG. 9 is another exploded perspective view of the second connector of the electrical connector assembly of FIG. 8.
Figure 10:
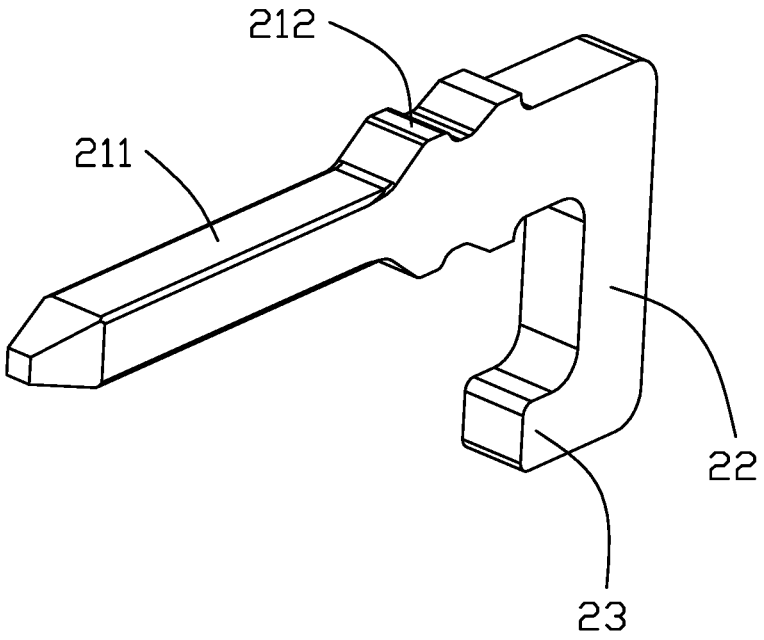
FIG. 10 is a perspective view of the contact of the first connector of the electrical connector assembly of FIG. 5
Figure 11:
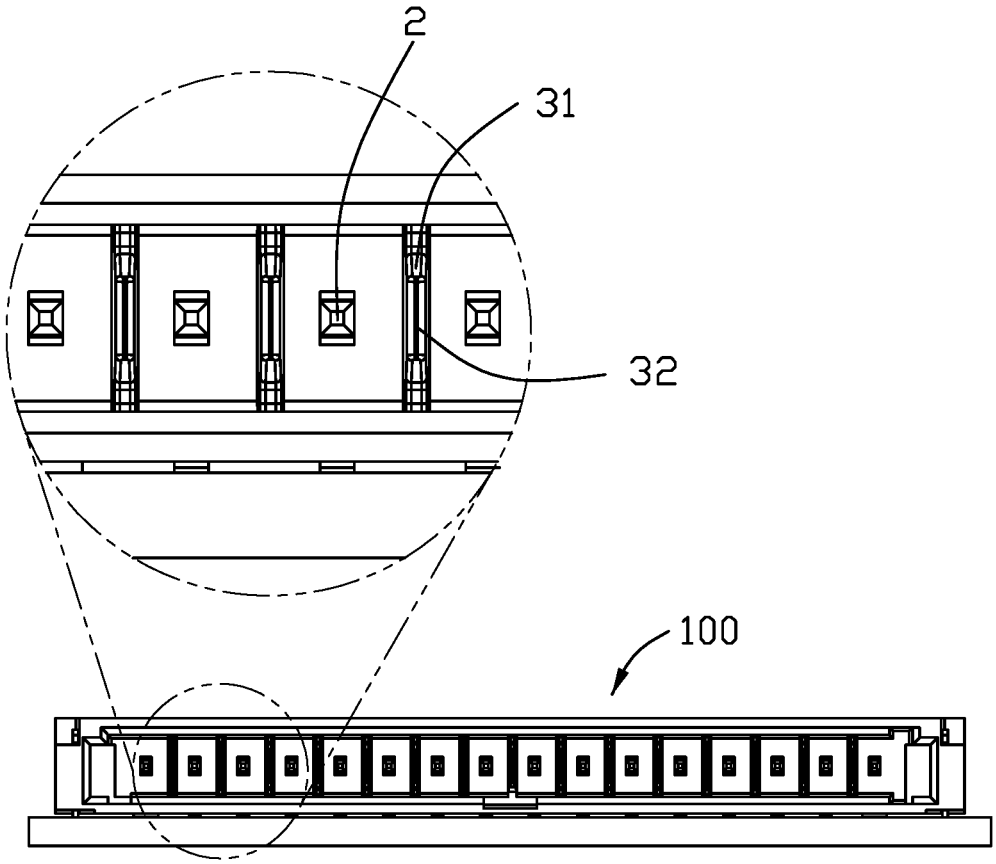
FIG. 11 is a front elevational view of the first connector of the electrical connector assembly of FIG. 5.
Figure 12:
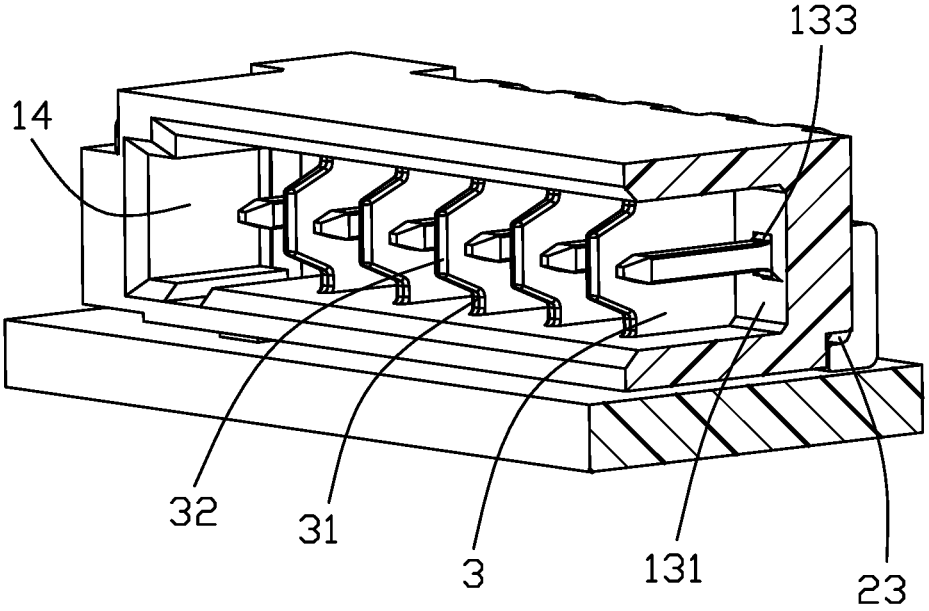
FIG. 12 is a cut-off perspective view of the first connector of the electrical connector of FIG. 5.
Figure 13:
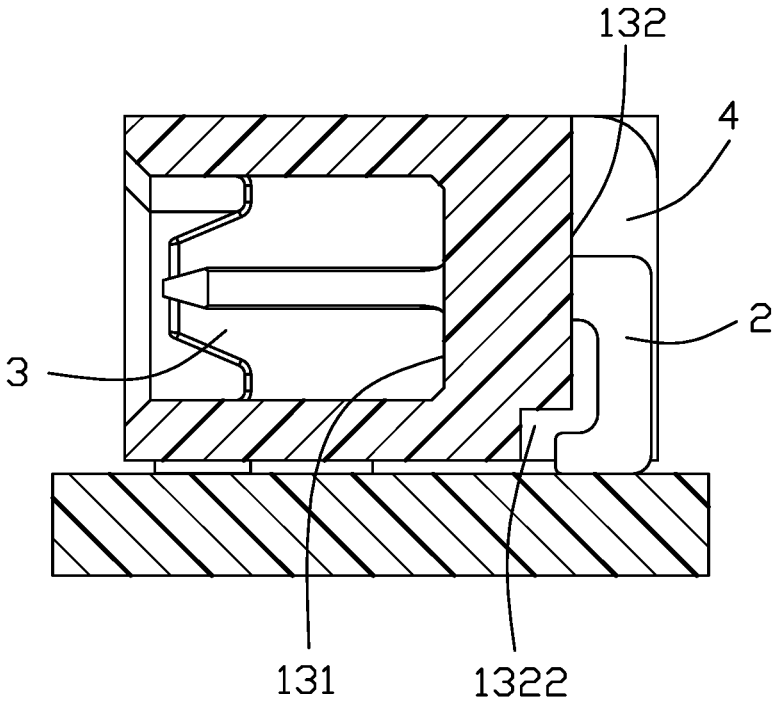
FIG. 13 is a cross-sectional view of the first connector of the electrical connector of FIG. 5.
Figure 14:
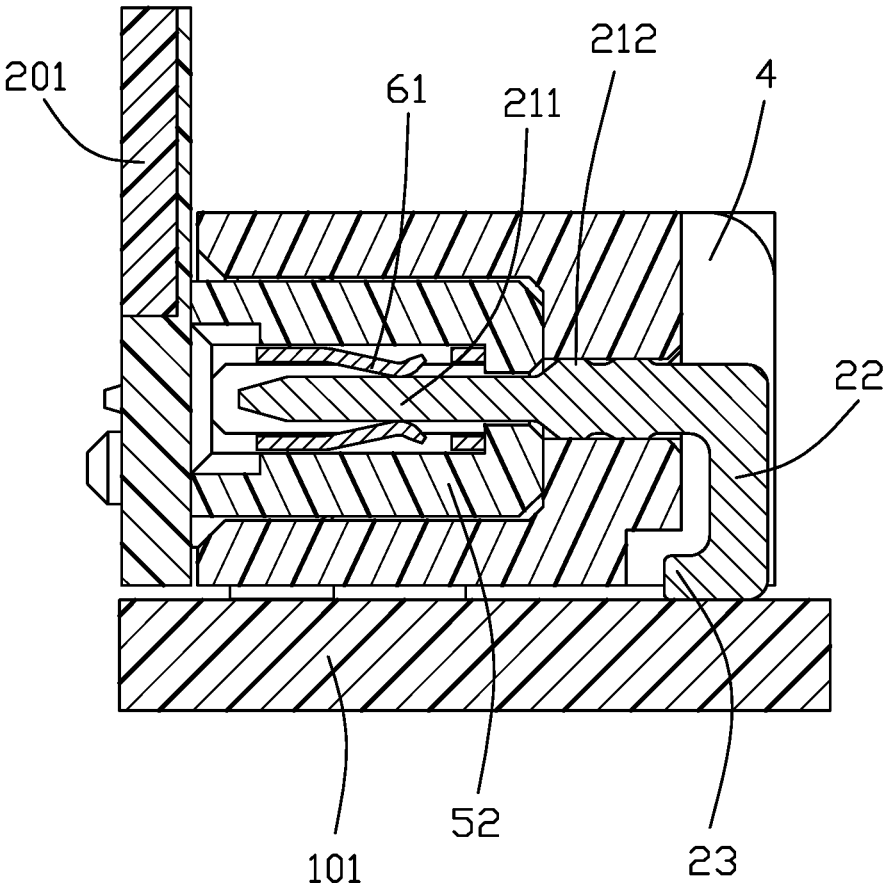
FIG. 14 is a cross-sectional view of the electrical connector assembly of FIG. 1 to show how the contact of the first connector and the contact of the second connector are mated with each other.
Figure 15:
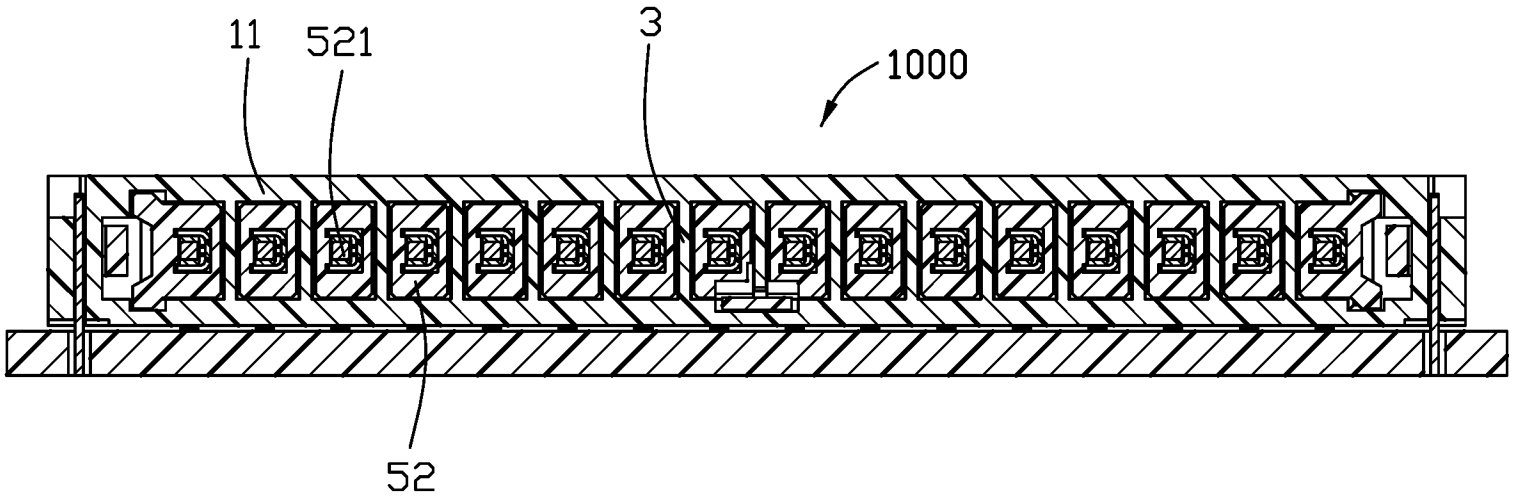
FIG. 15 is another cross-sectional view of the electrical connector assembly of FIG. 1 to show the contact of the first connector and the contact of the second connector are mated with each other.
Figure 16:
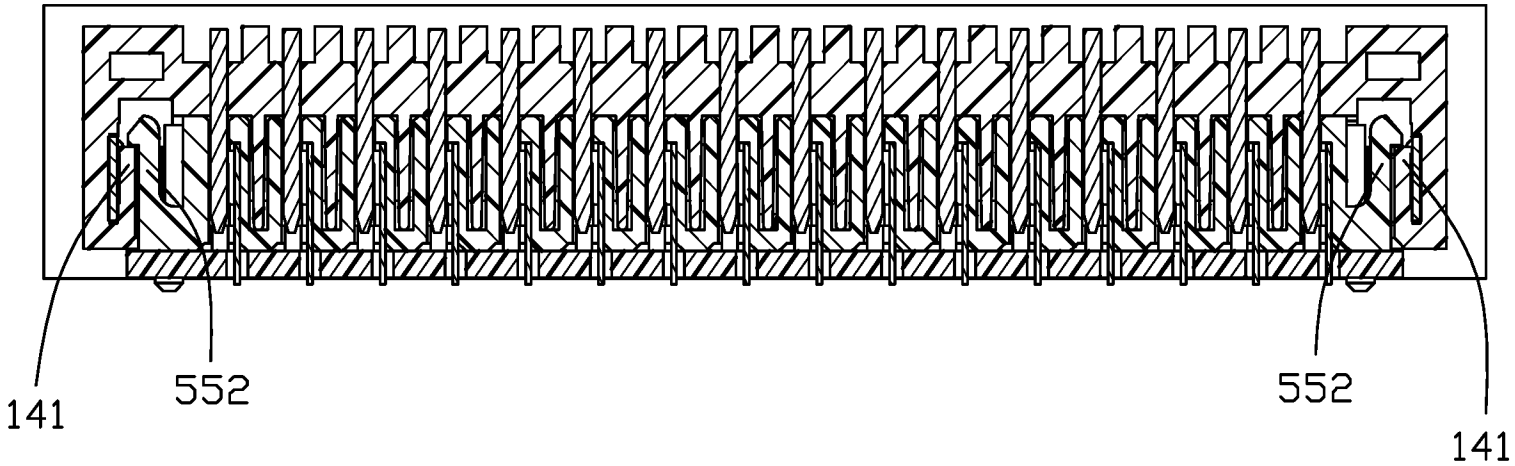
FIG. 16 is another cross-sectional view of the electrical connector assembly of FIG. 1 to show how the first connector and the second connector are latched with each other at the opposite ends.
Figure 17:
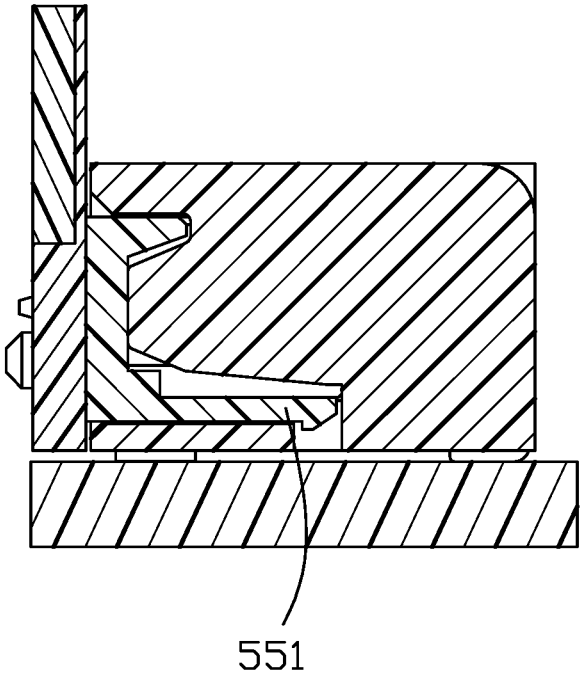
FIG. 17 is another cross-sectional view of the electrical connector assembly of FIG. 1 to show how the first connector and the second connector are latched with each other at the center region.

Reference will now be made in detail to the embodiments of the present disclosure. The electrical connector assembly 1000 includes a first connector 100 mounted to the first printed circuit board 101, and is adapted to be mated with a second connector 200 mounted upon a second printed circuit board 201. The first connector 100 includes an first insulative housing 1 and a plurality of first contacts 2 retained in the first housing 1. Correspondingly, the second connector 200 includes an second insulative housing 5 and a plurality of second contacts 6 retained in the second housing 5.

The first housing 1 includes opposite top wall 11 and bottom wall 12, a rear wall 13 connected between the top wall 11 and the bottom wall 12, and a pair of end walls 14 linked among the top wall 11, the bottom wall 12 and the rear wall 13 to commonly form a mating cavity 15. The rear wall 13 includes opposite interior surface 131 and exterior surface 132, and a plurality of passageways 133 extending therethrough. A plurality of grooves 1321 and a plurality of tail grooves 1322 are formed in the exterior surface 132 by the corresponding outer partitions 4 which extend rearwardly from the exterior surface 132 wherein the tail grooves 1322 are communicatively located under the corresponding grooves 1321, respectively. The passageways 133 are communicatively located at a mid-level of the corresponding grooves 1321, respectively. A plurality of inner partitions 3 are formed on the interior surface 131 and extend into the mating cavity 15 from the top wall 11 to the bottom wall 12. The inner partition 3 includes two opposite recesses 31 and a head 32 therebetween in the vertical direction wherein the one recess is joined to the top wall 11 and the other recess is joined to the bottom wall 12. The inner partitions 3 and the outer partitions 4 are aligned with each other in a front-to-back direction, respectively, while the outer partitions 4 are wider than the corresponding inner partitions 3, respectively, in the longitudinal direction of the electrical connector assembly 1000.

The first contact 2 is made by stamping and of a pin type, and includes a horizontal section 21, a vertical section 22 extending downwardly from the rear end of the horizontal section 21, and a soldering section 23 extending forwardly from the bottom end of the vertical section 22 so that both the horizontal section 21 and the soldering section 23 are located on a same side of the vertical section 22. The horizontal section 21 includes a pin type contacting section 211 and two pairs of barbs 212. Notably, the soldering section 23 is essentially located behind the barbs 212 in the front-to-back direction. The contacting section 211 extends through the passageway 133 and into the mating cavity 15. The barbs 212 are retained to the rear wall 13. The vertical section 22 is located in the corresponding groove 1321. The soldering section 23 is exposed outside of the exterior surface 132 while still within the corresponding tail groove 1322. In brief, the contacting section 211 is protectively located between the pair of inner partitions 3 by two sides and the soldering section 23 is protectively located between the pair of outer partitions 4 by two sides.

The second housing 5 of the second connector 200 includes a base 51 and a plurality of silos 52 extending from the base 51 and alternately arranged with the partition grooves 53 along the longitudinal direction of the base 51. Each silo 52 forms a hole 521 to receive a second contact 6. The base 51 includes opposite top face 54 and bottom face 55, and the partition grooves 53 extend through both the top face 51 and the bottom face 52 and the front face (not labeled) of the second housing 5. The housing 5 further includes a deflectable latch 551 adapted to be moved along the channel 121 in the bottom wall 12 of the first housing 1 for locking the first housing 1 and the second housing 2 together. Similarly, the housing 5 further includes a pair of deflectable latches 552 at two opposite longitudinal ends adapted to be engaged with corresponding steps 141 of the first housing 1 during mating. Notably, the three sided latching, i.e., the latch 551 and the pair of latches 552, may provide reliable securing between the first connector 100 and the second connector 200. The second contact 6 includes the clamping arm 61 disposed in the hole 521. During mating, the inner partitions 3 are respectively received in the corresponding partition grooves 53, and the contacting section 211 of the first contacts 2 are gripped by the clamping arms 61 of the second contacts 6.

While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. An electrical connector assembly comprising:

a first connector and a second connector adapted to be mounted to respective printed circuit boards and mated with each other, said first connector including a first insulative housing and a plurality of first contacts retained in the first insulative housing, the first insulative housing including opposite top wall and bottom wall in a vertical direction wherein the bottom wall is adapted to be mounted to the corresponding printed circuit board, a pair of end walls along a longitudinal direction perpendicular to said vertical direction, and a rear wall in a front-to-back direction perpendicular to both said vertical direction and said longitudinal direction to commonly form a mating cavity forwardly communicating with an exterior in said front-to-back direction;

said second connector including a second insulative housing adapted to be received in the mating cavity, and a plurality of second contacts retained in the second insulative housing; wherein a first deflectable latch is located at a middle region of the second insulative housing, and a pair of second deflectable latches are located at two opposite ends of the second insulative housing in said longitudinal direction; wherein during mating, the first deflectable latch of the second connector is received in the mating cavity around the bottom wall of the first connector in a substantially fully hidden manner.

2. The electrical connector assembly as claimed in claim 1, wherein the second insulative housing includes a plurality of silos to respectively receive the corresponding second contacts, and further receive the corresponding first contacts during mating.

3. The electrical connector assembly as claimed in claim 2, wherein each of said first contacts includes a front contacting section exposed within the mating cavity, and a vertical section exposed around the rear wall, and the first insulative housing forms a plurality of inner partitions extending forwardly from the rear wall to separate the corresponding contacting sections and a plurality of outer partitions extending rearwardly from the rear wall to form corresponding grooves between every adjacent two outer partitions to receive the vertical sections, respectively.

4. The electrical connector assembly as claimed in claim 3, wherein the second insulative housing forms a plurality of partition grooves between every adjacent two silos to receive the corresponding inner partitions of the first insulative housing, respectively, during mating.

5. The electrical connector assembly as claimed in claim 3, wherein each of the first contacts further including a soldering section forwardly extending from a bottom end of the vertical section.

6. The electrical connector assembly as claimed in claim 5, wherein in each of said first contacts, the soldering section and the contacting section are located on a same side with regard to the rear wall.

7. The electrical connector assembly as claimed in claim 6, wherein said first insulative housing further includes a plurality of tail grooves communicatively below the corresponding grooves to receive the corresponding soldering section.

8. An electrical connector assembly comprising:

a first connector and a second connector configured to be mated with each other, said first connector including first insulative housing and a plurality of first contacts retained in the first insulative housing;

the first insulative housing including opposite top wall and bottom wall in a vertical direction, a pair of end walls along a longitudinal direction perpendicular to said vertical direction, and a rear wall in a front-to-back direction perpendicular to both said vertical direction and said longitudinal direction to commonly form a mating cavity forwardly communicating with an exterior in said front-to-back direction; and each of said first contacts including a front contacting section exposed in the mating cavity, and a rear vertical section exposed around the rear wall, and a soldering section extending from a bottom end of the vertical section; wherein the first housing forms a plurality of inner partitions in the mating cavity to separate the corresponding contacting sections, respectively, and a plurality of outer partitions behind the rear wall to form corresponding grooves in which the corresponding vertical sections are received, respectively; wherein each of said outer partitions is dimensioned to be substantially larger than the vertical section of the neighboring contact in both the vertical direction and the front-to-back direction for efficient shielding in the longitudinal direction.

9. The electrical connector assembly as claimed 8, wherein the inner partitions unitarily extend forwardly from the rear wall, and the outer partitions unitarily extend rearwardly from the rear wall.

10. The electrical connector assembly as claimed in claim 9, wherein said inner partitions are further linked to both the top wall and the bottom wall.

11. The electrical connector assembly as claimed in claim 9, wherein the rear wall further forms a plurality of tail grooves communicatively below the corresponding grooves to receive the corresponding soldering sections which extend forwardly from the corresponding vertical sections in the front-to-back direction, respectively.

12. The electrical connector assembly as claimed in claim 8, wherein the second insulative housing includes a plurality of silos to respectively receive the corresponding second contacts, and further receive the corresponding first contacts during mating.

13. The electrical connector assembly as claimed in claim 12, wherein the second insulative housing forms a plurality of partition grooves between every adjacent two silos to receive the corresponding inner partitions of the first insulative housing, respectively, during mating.

14. The electrical connector assembly as claimed in claim 1, wherein during mating, the pair of second deflectable latches of the second connector are received in the mating cavity of the first connector in a fully hidden manner.

15. A electrical connector for use with another connector having a plurality of silos receiving corresponding terminals therein and forming corresponding partition grooves therebetween, comprising:

an insulative housing including opposite top wall and bottom wall in a vertical direction, a pair of end walls along a longitudinal direction perpendicular to said vertical direction, and a rear wall in a front-to-back direction perpendicular to both said vertical direction and said longitudinal direction to commonly form a mating cavity forwardly communicating with an exterior in said front-to-back direction; and a plurality of contacts retained to the housing, each of said contacts including a vertical section located behind the rear wall, a horizontal section extending forwardly from an upper side of the vertical section and having a barbs retained to the rear wall and a contacting section exposed in the mating cavity, and a soldering section extending forwardly from a bottom side of the vertical section; wherein said housing further includes a plurality inner partitions in the mating cavity to separate the contacting sections and be adapted to be received within the partition grooves, and a plurality of outer partitions behind the rear wall to separate the vertical sections; wherein a plurality of grooves are formed between the corresponding outer partitions to respectively receive the corresponding vertical sections, and a plurality of tail grooves are formed below the rear wall and communicatively aligned with the corresponding grooves to receive the corresponding soldering sections, respectively.

16. The electrical connector as claimed in claim 15, wherein each of said inner partitions unitarily extends forwardly from the rear wall.

17. The electrical connector as claimed in claim 16, wherein each of said inner partitions is further linked to both the top wall and the bottom wall.

18. The electrical connector as claimed in claim 17, wherein a pair of recesses are formed in a front edge of each of the inner partitions.

19. The electrical connector assembly as claim 15, wherein a step is formed at each end wall for engagement with a corresponding latch of said another connector in a fully hidden manner during mating.

20. The electrical connector assembly as claimed in claim 15, wherein each of said outer partitions is dimensioned to be substantially larger than the vertical section of the neighboring contact in both the vertical direction and the front-to-back direction for efficient shielding in the longitudinal direction.

* * * * *